US009530581B2

(12) United States Patent
Bonavides et al.

(10) Patent No.: US 9,530,581 B2
(45) Date of Patent: Dec. 27, 2016

(54) CHANGING THE STATE OF A SWITCH THROUGH THE APPLICATION OF POWER

(75) Inventors: Clovis Satyro Bonavides, Houston, TX (US); Daniel F Dorffer, Houston, TX (US); Jim Taylor Hill, Kingwood, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 306 days.

(21) Appl. No.: 14/119,294

(22) PCT Filed: Jun. 2, 2011

(86) PCT No.: PCT/US2011/038900
§ 371 (c)(1),
(2), (4) Date: Nov. 21, 2013

(87) PCT Pub. No.: WO2012/166143
PCT Pub. Date: Dec. 6, 2012

(65) Prior Publication Data

US 2014/0091893 A1 Apr. 3, 2014

(51) Int. Cl.
*H01H 5/04* (2006.01)
*H01H 85/46* (2006.01)
(Continued)

(52) U.S. Cl.
CPC ..... *H01H 5/04* (2013.01); *H01H 3/30* (2013.01); *H01H 37/76* (2013.01); *H01H 37/761* (2013.01);
(Continued)

(58) Field of Classification Search
CPC ..... H01H 5/04; H01H 85/46; H01H 37/76; H01H 37/767; H01H 61/04; H01H 61/02; H01H 85/36; H01H 37/761; H01H 3/30; H01H 2037/762; H01H 2037/763; F42C 15/40; F42C 19/00; F42C 15/36
(Continued)

(56) References Cited

U.S. PATENT DOCUMENTS 2,344,173 A 3/1944 Ruge
3,168,141 A 2/1965 Lebourg
(Continued)

FOREIGN PATENT DOCUMENTS

CN 1030824 A 2/1989
CN 101389826 A 3/2009
(Continued)

OTHER PUBLICATIONS

Australian Government IP Australia, Patent Examination Report No. 1, Patent Application No. 2013274760, Nov. 10, 2014.
(Continued)

*Primary Examiner* — Anatoly Vortman
(74) *Attorney, Agent, or Firm* — Howard L. Speight, PLLC

(57) ABSTRACT

A switch includes a spring. The switch further includes a collapsing element. The spring has a first state in which it is being held in tension by a restraining element and a second state in which it is not being held in tension because the restraining element has failed. The collapsing element is situated such that when sufficient power is applied to the collapsing element heat from the collapsing element will cause the restraining element to fail. The switch further includes a first contact coupled to the spring. The switch further includes a second contact coupled to the spring. The first contact and the second contact are separate from each other when the spring is in the first state. The first contact and the second contact are electrically connected to each other when the spring is in the second state.

18 Claims, 10 Drawing Sheets

(51) Int. Cl.

| | |
|---|---|
| ***H01H 85/36*** | (2006.01) |
| ***H01H 3/30*** | (2006.01) |
| ***H01H 61/02*** | (2006.01) |
| ***H01H 61/04*** | (2006.01) |
| *H01H 37/76* | (2006.01) |
| *F42C 15/36* | (2006.01) |
| *F42C 15/40* | (2006.01) |
| *F42C 19/00* | (2006.01) |

(52) U.S. Cl.
CPC ..... *H01H 37/767* (2013.01); *H01H 61/02* (2013.01); *H01H 61/04* (2013.01); *H01H 85/36* (2013.01); *H01H 85/46* (2013.01); *F42C 15/36* (2013.01); *F42C 15/40* (2013.01); *F42C 19/00* (2013.01); *H01H 2037/762* (2013.01); *H01H 2037/763* (2013.01)

(58) Field of Classification Search
USPC .... 337/4, 142, 147, 153, 154, 157, 401, 407
See application file for complete search history.

(56) References Cited

U.S. PATENT DOCUMENTS

| | | | | |
|---|---|---|---|---|
| 3,309,481 | A | 3/1967 | Merrill | |
| 3,676,945 | A | 7/1972 | Neanhouse | |
| 3,717,095 | A | 2/1973 | Vann | |
| 4,047,143 | A * | 9/1977 | Burden | H01H 85/36 337/239 |
| 4,099,818 | A | 7/1978 | Meinzer | |
| 4,124,835 | A * | 11/1978 | Cahill, Jr. | G01R 11/00 337/1 |
| 4,151,383 | A | 4/1979 | Miyata | |
| 4,186,366 | A * | 1/1980 | McVey | H01H 37/766 337/407 |
| 4,288,833 | A * | 9/1981 | Howell | H02H 9/06 337/16 |
| 4,808,960 | A * | 2/1989 | Nixon | H01H 61/02 337/102 |
| 4,821,010 | A * | 4/1989 | Plasko | H01H 61/02 337/183 |
| 4,869,170 | A | 9/1989 | Dahmberg et al. | |
| 4,927,988 | A | 5/1990 | Nolte | |
| 5,014,036 | A * | 5/1991 | Komoto | H01H 9/102 337/4 |
| 5,105,742 | A | 4/1992 | Sumner | |
| 5,115,865 | A | 5/1992 | Carisella et al. | |
| 5,831,507 | A * | 11/1998 | Kasamatsu | H01H 9/10 337/299 |
| 5,839,508 | A | 11/1998 | Tubel et al. | |
| 5,908,365 | A | 6/1999 | LaJaunie et al. | |
| 5,967,297 | A | 10/1999 | Kaufman et al. | |
| 6,070,672 | A | 6/2000 | Gazda | |
| 6,741,159 | B1 * | 5/2004 | Kuczynski | H01H 37/002 337/142 |
| 7,345,568 | B2 * | 3/2008 | Yu | H01H 37/002 337/13 |
| 7,387,162 | B2 | 6/2008 | Mooney, Jr. et al. | |
| 8,432,246 | B2 * | 4/2013 | Suzuki | H01H 9/12 200/61.08 |
| 2001/0027864 | A1 | 10/2001 | Vaynshteyn | |
| 2003/0213595 | A1 | 11/2003 | Jackson | |
| 2005/0128043 | A1 * | 6/2005 | Ying | H01H 9/32 337/36 |
| 2007/0207669 | A1 | 9/2007 | Hummel et al. | |
| 2009/0316319 | A1 * | 12/2009 | Depping | H01C 7/126 361/91.1 |
| 2010/0245022 | A1 * | 9/2010 | Galla | H01H 37/761 337/159 |
| 2012/0068806 | A1 * | 3/2012 | Guarniere | H01C 7/10 337/1 |
| 2012/0194315 | A1 * | 8/2012 | Matthiesen | H01H 37/761 337/142 |
| 2012/0229246 | A1 * | 9/2012 | Depping | H01C 7/12 337/114 |
| 2014/0185178 | A1 * | 7/2014 | Bonavides | F42C 15/36 361/115 |
| 2014/0345485 | A1 * | 11/2014 | Molina | E21B 43/1185 102/202.14 |

FOREIGN PATENT DOCUMENTS

| | | |
|---|---|---|
| CN | 1934406 B | 6/2011 |
| DE | G89C3566.6 | 10/1989 |
| EP | 0144660 A1 | 6/1985 |
| EP | 0931906 A2 | 7/1999 |

OTHER PUBLICATIONS

European Patent Office, European Patent Publication, Electrical Connection Device, such as a Socket-Outlet, for Electrical Power-Consuming Devices, Publication Date: Jun. 19, 1985 which is a translation of EP0144660.

European Patent Office, European Search Report, Application No./Patent No. 11866905.0-1808/2697811 PCT/US2011055729 (which is the EP counterpart of a US matter (U.S. Appl. No. 14/119,310) that is related to the instant application), Oct. 28, 2014.

Federal Republic of Germany, German Patent Office, Electrical Switch, Publication date: Oct. 26, 1989 which is a translation of Gebrauchsmuster DE G C3 566.6.

USPTO, Notice of Allowance, Safely Deploying Power, Date Mailed: Sep. 29, 2014, U.S. Appl. No. 14/119,335, which is related to the instant application.

International Searching Authority, International Search Report and the Written Opinion of the International Searching Authority in PCT/US2012/035338, Aug. 3, 2012.

The State Intellectual Property Office of the People's Republic of China, Notice on the First Office Action, Application/Patent No. 201180071340.8, which is a CN counterpart of a related US matter (U.S. Appl. No. 14/119,310) of the instant application, Apr. 17, 2015.

Translation of the argument in the the State Intellectual Property Office of the People's Republic of China, Notice on the First Office Action, Application/Patent No. 201180071340.8, which is a CN counterpart of a related US matter (U.S. Appl. No. 14/119,310) of the instant application, Apr. 17, 2015.

Translation of the non-argument portions of the State Intellectual Property Office of the People's Republic of China, Notice on the First Office Action, Application/Patent No. 201180071340.8, which is a CN counterpart of a related US matter (U.S. Appl. No. 14/119,310) of the instant application, Apr. 17, 2015.

International Preliminary Examining Authority, International Preliminary Report on Patentability in PCT/US11/38900, Jun. 6, 2013.

International Preliminary Examining Authority, International Preliminary Report on Patentability in PCT/US2011/055729, Jun. 28, 2013.

International Preliminary Examining Authority, International Preliminary Report on Patentability in PCT/US2012/035338, Oct. 4, 2013.

International Searching Authority, International Search Report and the Written Opinion of the International Searching Authority in PCT/US2011/055729, Mar. 2, 2012.

International Searching Authority, International Search Report and the Written Opinion of the International Searching Authority in PCT/US2012/035338, Aug. 30, 2012.

International Searching Authority, International Search Report and the Written Opinion of the International Searching Authority in PCT/US2011/038900, Oct. 7, 2011.

Canadian Intellectual Property Office, Examiners Letter, Application No. 2,834,244, (which is a CA counterpart of a US matter (U.S. Appl. No. 14/119,310) that is related to the instant application), Feb. 19, 2015.

Discovery House, IP Australia, Patent Examination Report No. 1, Patent Application No. 2011369375 (which is the AU counterpart of a US matter (U.S. Appl. No. 14/119,310) that is related to the instant application), Mar. 2, 2015.

(56) References Cited

OTHER PUBLICATIONS

The State Intellectual Property Office of the People's Republic of China, Notice on Grant of Patent Rights for Invention, Application/Patent No. 201180071340.8, which is a CN counterpart application to a related US Matter (U.S. Appl. No. 14/119,310) of the instant application, Jan. 4, 2016, a translation filed herewith.
United States Patent and Trademark Office, Notice of Non-Final Office Action, U.S. Appl. No. 14/119,294, which is a related US matter of the instant application, Nov. 25, 2015.
Discovery House, Australian Government IP Australia, Notice of Acceptance, Application No. 2011369375, which is an AU counterpart of a related US matter (U.S. Appl. No. 14/119,310) of the instant application, Oct. 16, 2015.
The State of Intellectual Property Office of the People's Republic of China, Notice of the Second Office Action, Application/Patent No. 201180071340.8, which is a CN counterpart of a related US matter (U.S. Appl. No. 14/119,310) of the instant application, Oct. 21, 2015.
Translation of the State of Intellectual Property Office of the People's Republic of China, Notice of the Second Office Action, Application/Patent No. 201180071340.8, which is a CN counterpart of a related US matter (U.S. Appl. No. 14/119,310) of the instant application, Oct. 21, 2015.
United States Patent and Trademark Office, Notice of Non-Final Office Action, U.S. Appl. No. 14/119,310, which is related US matter of the instant application, Dec. 7, 2015.
Canadian Intellectual Property Office, Notice of Allowance, Application No. 2,834,244, which is a CA counterpart to the instant application, Oct. 14, 2015.
Patent Office of the Cooperation Council for the Arab States of the Gulf, Examination Report, Application No. GC 2012-21397, which is a GCC counterpart to the instant application, Apr. 11, 2016.
Australian Government IP Australia, Notice of Grant, Patent No. 2011369375, which is an AU counterpart of a related US application to the instant application, Feb. 11, 2016.
English translation of the State Intellectual Property Office of the People's Republic of China, Notice of Grant of Patent Right for Invention, Application/Patent No. 201180071340.8, which is a CN counterpart of a related US application (U.S. Appl. No. 14/119,310) to the instant application, Jan. 4, 2016.
European Patent Office, Communication pursuant to Article 94(3) EPC, Application No. 11 866 905.0-1808, which is an EP counterpart of a related (U.S. Appl. No. 14/119,310) to the instant application, Mar. 11, 2016.
The State Intellectual Property Office of the People's Republic of China, Notice of Grant of Patent Right for Invention, Application/Patent No. 201180071340.8, which is a CN counterpart of a related (U.S. Appl. No. 14/119,310) to the instant application, Jan. 4, 2016, translation filed herewith.
United States Patent and Trademark Office, Final Office Action, U.S. Appl. No. 14/119,310, which is related US matter of the instant application, Apr. 27, 2016.

* cited by examiner

CHANGING THE STATE OF A SWITCH THROUGH THE APPLICATION OF POWER

CROSS-REFERENCE TO RELATED APPLICATIONS

This application is a U.S. national phase application claiming priority to International Application No. PCT/US2011/038900, entitled "Changing the State of a Switch Through the Application of Power," filed on Jun. 2, 2011.

BACKGROUND

An oil well typically goes through a "completion" process after it is drilled. Casing is installed in the well bore and cement is poured around the casing. This process stabilizes the well bore and keeps it from collapsing. Part of the completion process involves perforating the casing and cement so that fluids in the formations can flow through the cement and casing and be brought to the surface. The perforation process is often accomplished with shaped explosive charges. These perforation charges are often fired by applying electrical power to an initiator. Applying the power to the initiator in the downhole environment is a challenge.

DETAILED DESCRIPTION

The switch described herein can be used in a large number of applications. It will be described in the context of a downhole perforating system but that description is being provided as an example only and should not be understood to limit the application of the switch.

Figure 1:
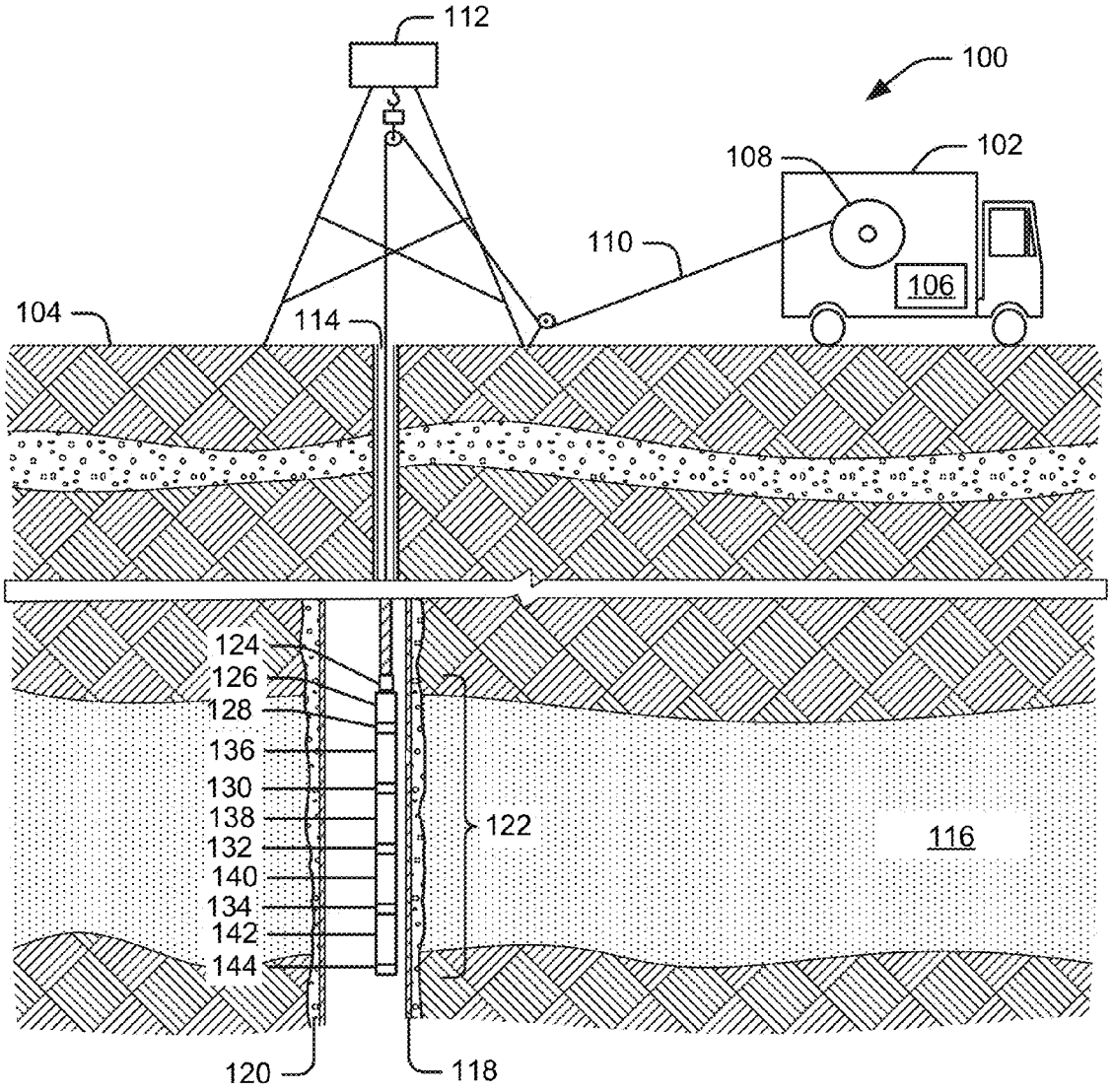
FIG. 1 illustrates a perforation system.

In one embodiment of a perforation system 100 at a drilling site, as depicted in FIG. 1, a logging truck or skid 102 on the earth's surface 104 houses a shooting panel 106 and a winch 108 from which a cable 110 extends through a derrick 112 into a well bore 114 drilled into a hydrocarbon-producing formation 116. In one embodiment, the derrick 112 is replaced by a truck with a crane (not shown). The well bore is lined with casing 118 and cement 120. The cable 110 suspends a perforation apparatus 122 within the well bore 114.

Figure 2:
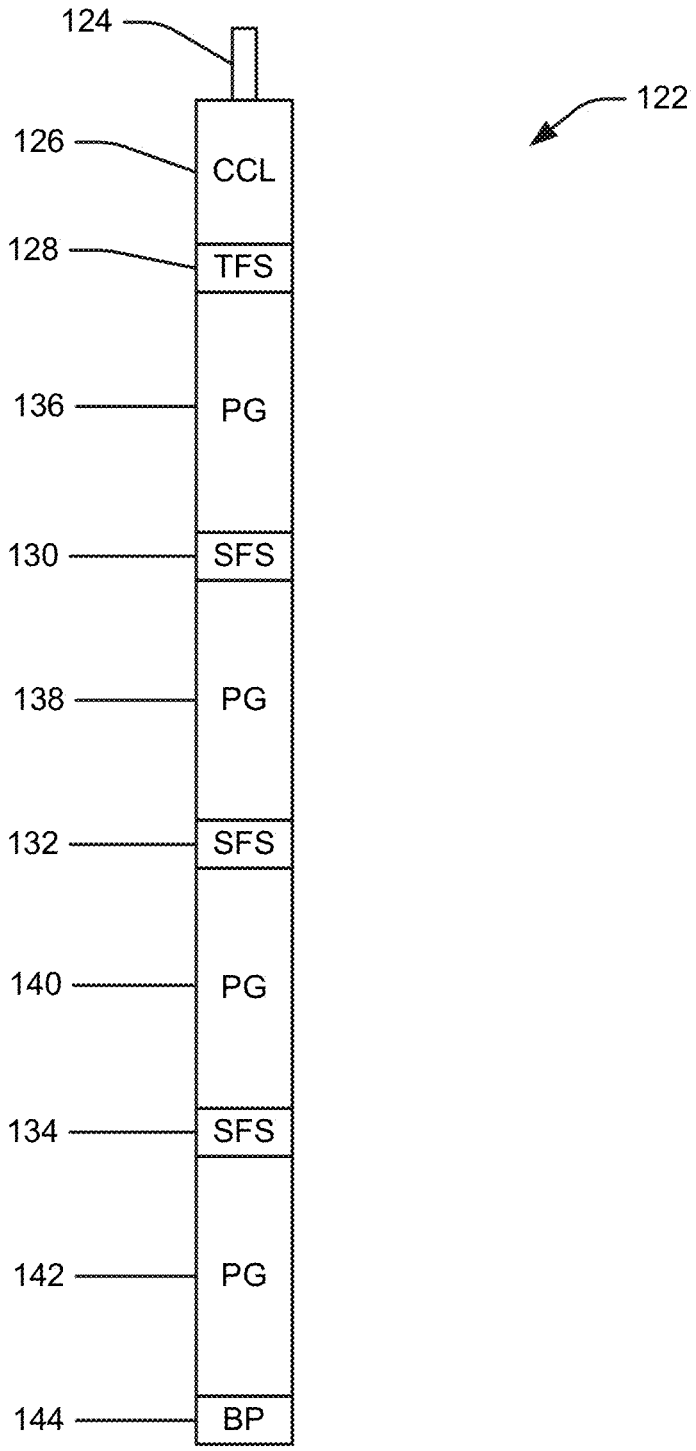
FIG. 2 illustrates a perforation apparatus.

In one embodiment shown in FIGS. 1 and 2, the perforation apparatus 122 includes a cable head/rope socket 124 to which the cable 110 is coupled. In one embodiment, an apparatus to facilitate fishing the perforation apparatus (not shown) is included above the cable head/rope socket 124. In one embodiment, the perforation apparatus 122 includes a casing collar locator ("CCL") 126, which facilitates the use of magnetic fields to locate the thicker metal in the casing collars (not shown). The information collected by the CCL can be used to locate the perforation apparatus 122 in the well bore 114. A gamma-perforator (not shown), which includes a CCL, may be included as a depth correlation device in the perforation apparatus 122.

In one embodiment, the perforation apparatus 122 includes a top fire sub ("TFS") 128 that provides an electrical and control interface between the shooting panel 106 on the surface and the rest of the equipment in the perforation apparatus 122.

In one embodiment, the perforation apparatus 122 includes a plurality of select fire subs ("SFS") 130, 132, 134 and a plurality of perforation charge elements (or perforating gun or "PG") 136, 138, 140, and 142. In one embodiment, the number of select fire subs is one less than the number of perforation charge elements.

Figure 4:
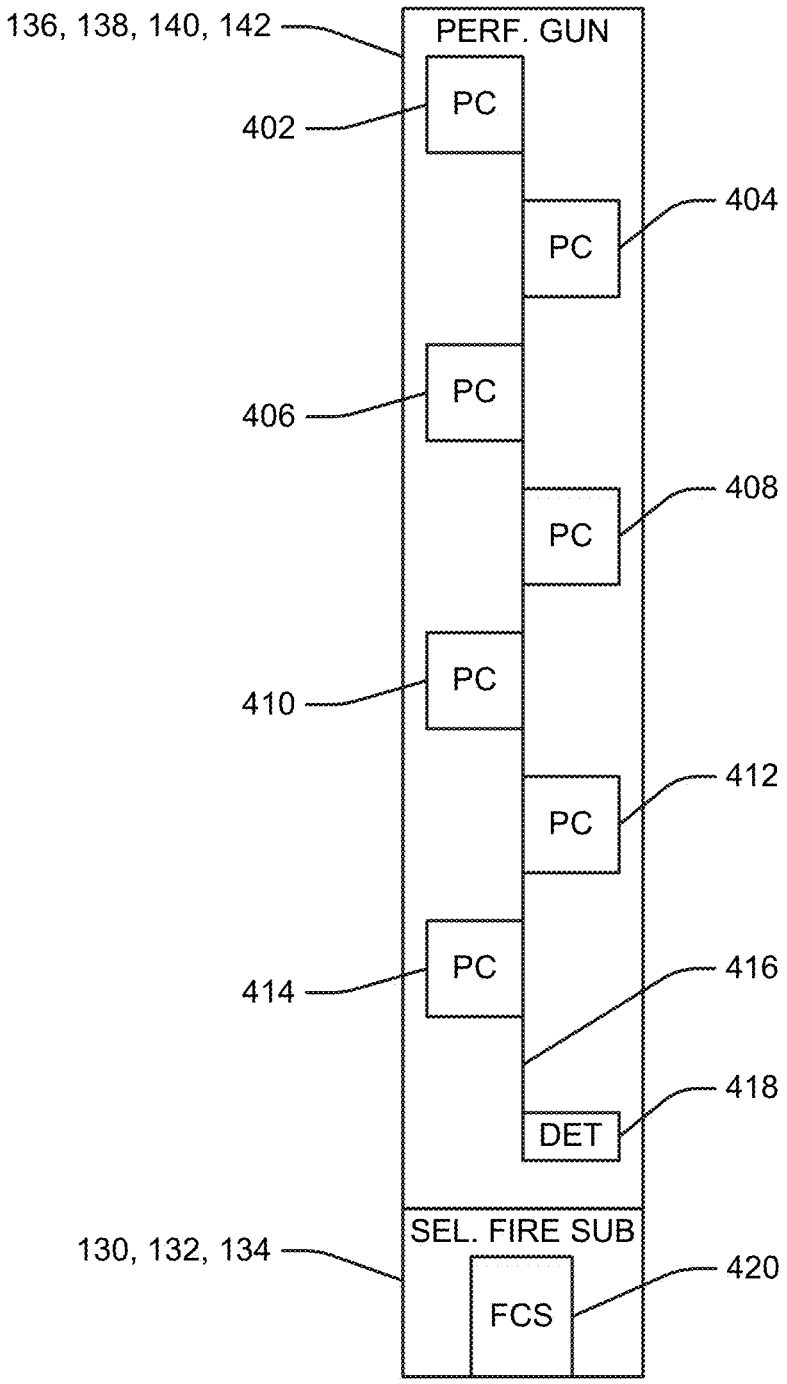
FIG. 4 is a block diagram of a perforation apparatus.

The perforation charge elements 136, 138, and 140 are described in more detail in the discussion of FIG. 4. It will be understood by persons of ordinary skill in the art that the number of select fire subs and perforation charge elements shown in FIGS. 1 and 2 is merely illustrative and is not a limitation. Any number of select fire subs and sets of perforation charge elements can be included in the perforation apparatus 122.

Figure 3:
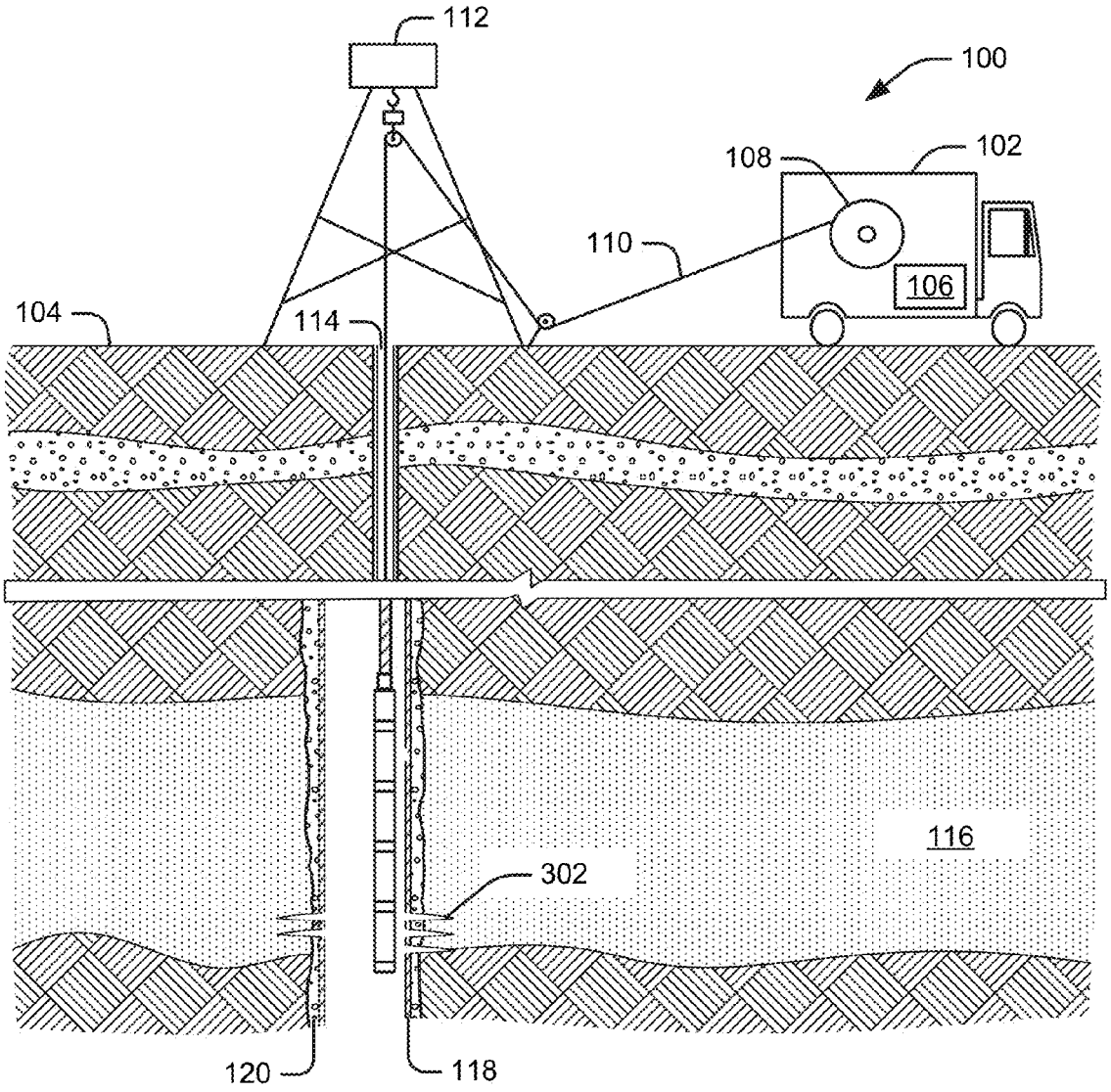
FIG. 3 illustrates the perforation system after one of the perforation charges has been fired.

In one embodiment, the perforation apparatus 122 includes a bull plug ("BP") 144 that facilitates the downward motion of the perforation apparatus 122 in the well bore 114 and provides a pressure barrier for protection of internal components of the perforation apparatus 122. In one embodiment, the perforation apparatus 122 includes magnetic decentralizers (not shown) that are magnetically drawn to the casing causing the perforation apparatus 122 to draw close to the casing as shown in FIG. 1. In one embodiment, a setting tool (not shown) is included to deploy and set a bridge or frac plug in the borehole FIG. 3 shows the result of the explosion of the lowest perforation charge element. Passages 302 (only one is labeled) have been created from the formation 116 through the concrete 120 and the casing 118. As a result, fluids can flow out of the formation 116 to the surface 104. Further, stimulation fluids may be pumped out of the casing 118 and into the formation 116 to serve various purposes in producing fluids from the formation 116.

One embodiment of a perforation charge element 136, 138, 140, 142, illustrated in FIG. 4, includes 6 perforating charges 402, 404, 406, 408, 410, 412, and 414. It will be understood that by a person of ordinary skill in the art that each perforation charge element 136, 138, 140, 142 can include any number of perforating charges.

In one embodiment, the perforating charges are linked together by a detonating cord 416 which is attached to a detonator 418. In one embodiment, when the detonator 418 is detonated, the detonating cord 416 links the explosive event to all the perforating charges 402, 404, 406, 408, 410, 412, 414, detonating them simultaneously. In one embodiment, a select fire sub 130, 132, 134 containing a single fire clip switch ("FCS") 420 is attached to the lower portion of the perforating charge element 136, 138, 140, 142. In one embodiment, the select fire sub 130, 132, 134 defines the polarity of the voltage required to detonate the detonator in the perforating charge element above the select fire sub. Thus in one embodiment, referring to FIG. 2, select fire sub 130 defines the polarity of perforating charge element 136, select fire sub 132 defines the polarity of perforating charge element 138, and select fire sub 134 defines the polarity of perforating charge element 140. In one embodiment, the bottom-most perforating charge element 142 is not coupled to a select fire sub and thus can be detonated by a voltage of either polarity.

Figure 5:
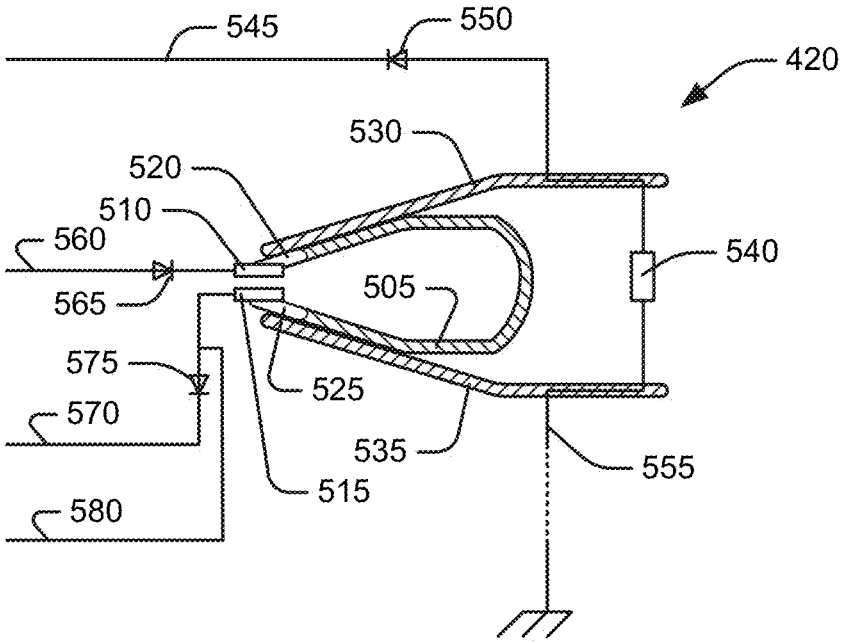
FIGS. 5-10, 12 and 13 illustrate fire clip switches.

In one embodiment illustrated in FIG. 5, a fire clip switch 420 includes a state-changing feature that is actuated by dissipating power across a collapsing element. In one embodiment, heat generated by the collapsing element triggers the state-change mechanism, causing the collapsing element to collapse or causing another element, such as a tie-wrap or an eutectic substance, to collapse or change physical state and to become significantly weak in a structural sense.

In one embodiment, the switch includes a C-shaped spring 505. In one embodiment, the spring 505 is mechanically coupled to a first contact 510 and a second contact 515. In one embodiment, portions of the spring, 520 and 525, adjacent to the first contact 510 and the second contact 515 are non-conductive to electricity. In one embodiment, the spring 505 is made of an elastic material such as steel. In one embodiment, in its non-deformed shape, the spring 505 closes more than is shown in FIG. 5 such that the first contact 510 and second contact 515 come into contact with each other and form a good electrical connection.

In one embodiment, the fire clip switch 420 includes two handles, or tension elements, 530 and 535. In one embodiment, the handles 530 and 535 are made of a material that is non-conductive material to electricity, such as plastic. In one embodiment, the handles 530 and 535 are mechanically coupled to the spring 505. In one embodiment, the handles 530, 535 are mechanically coupled to and held in the position shown in FIG. 5 by a collapsing element 540. That is, in one embodiment, the handles 530 and 535 are urged toward each other to the position shown in FIG. 5 and then the collapsing element 540 is mechanically affixed to the handles 530, 535 to hold them in place, which in turn deforms the spring 505 as shown in FIG. 1. In one embodiment, the spring 505 tends to urge the handles 530 and 535 away from each other such that when the fire clip switch 420 is in the state shown in FIG. 5, the collapsing element 540 is under mechanical stress.

In one embodiment, the collapsing element 540 is coupled to an "actuation" line 545 through a diode 550 and to a ground line 555.

In one embodiment, the first contact 510 is coupled to a "actuation" line 560 through a diode 565. In one embodiment, contact 515 is coupled to a "fire" line 570 through a diode 575. In one embodiment, diode 575 is optional but is recommended for the safety of the fire clip switch 420.

Figure 11:
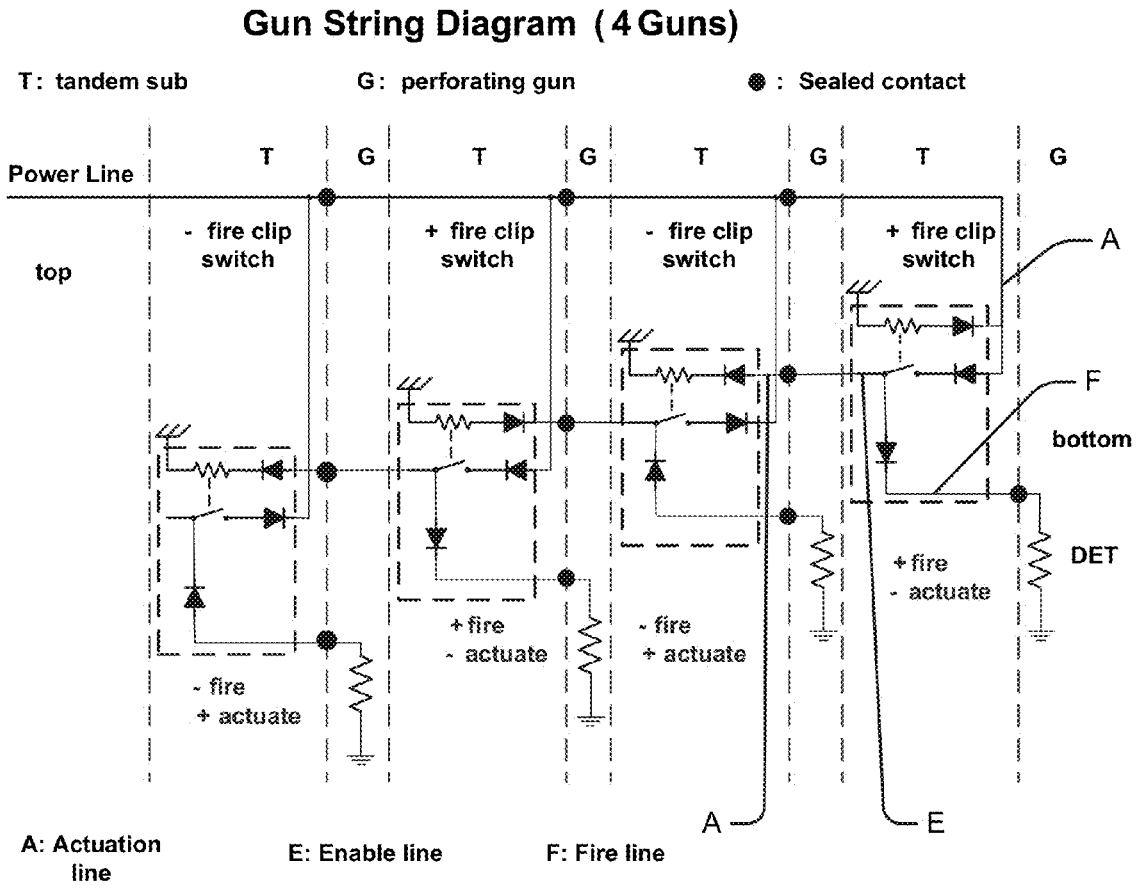
FIG. 11 illustrates a system that includes fire clip switches.

In one embodiment, an "enable" line 580 is coupled to the "actuation" line 560 of a higher switch in the perforation apparatus 122 so that fire clip switches can be chained together, as shown in FIG. 11. In one embodiment, the actuation line 560 of the bottommost switch is coupled to a "power" line as shown in FIG. 11.

Figure 6:
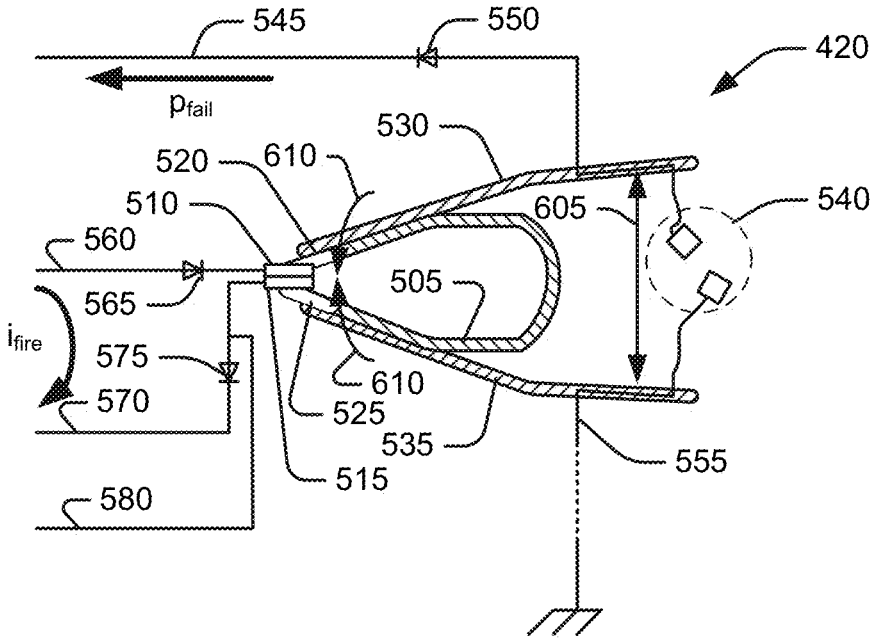

In one embodiment, as shown in FIG. 6, a power $p_{fail}$, shown by an arrow that reflects the polarity of the power $p_{fail}$, is applied to the collapsing element 540 where power $p_{fail}$ is sufficient to cause collapsing element 540 to fail, as indicated by the two broken parts in the circle designated 540 in FIG. 6.

For example, in one embodiment, the collapsing element 540 is a resistor. In one embodiment, the collapsing element 540 is a 10 watt resistor that explodes if it is exposed to 50 watts of power. In that case, if the voltage across the resistor collapsing element 540 is 200 volts and the current flowing through the resistor collapsing element 540 is 250 milliamps, the resistor 540 is being exposed to 50 watts (200 volts×250 milliamps) and the resistor 540 will fail by, for example, exploding.

In one embodiment, the collapsing element 540 is an electrolytic capacitor that is destroyed by the application of power of a sufficient magnitude and a "wrong" polarity. In one embodiment, the application of power $p_{fail}$ destroys the electrolytic capacitor.

In one embodiment, the collapsing element 540 is an electromagnetic choke with a magnetic core that fails catastrophically upon the application of power $p_{fail}$.

Persons of ordinary skill would recognize that the collapsing element 540 could be made from other components, such as semiconductors, etc., or an arrangement thereof, that collapse under the application of electrical power.

As mentioned above, when the fire clip switch 420 is in the state shown in FIG. 5, the collapsing element 540 is under stress and the spring 505 is urging the handles 530 and 535 apart. In one embodiment, when the collapsing element 540 fails, as shown in FIG. 6, the handles 530 and 535 move apart as indicated by the arrow 605 and the spring 505 moves as shown by the arrows 610. In one embodiment, the movement of the spring 505 causes the first contact 510 to come into contact with the second contact 515, closing a circuit between the power line 560 and the fire line 570 through diodes 565 and 575, which allows a current $i_{fire}$ to flow in the direction shown by the arrow in FIG. 6.

Figure 7:
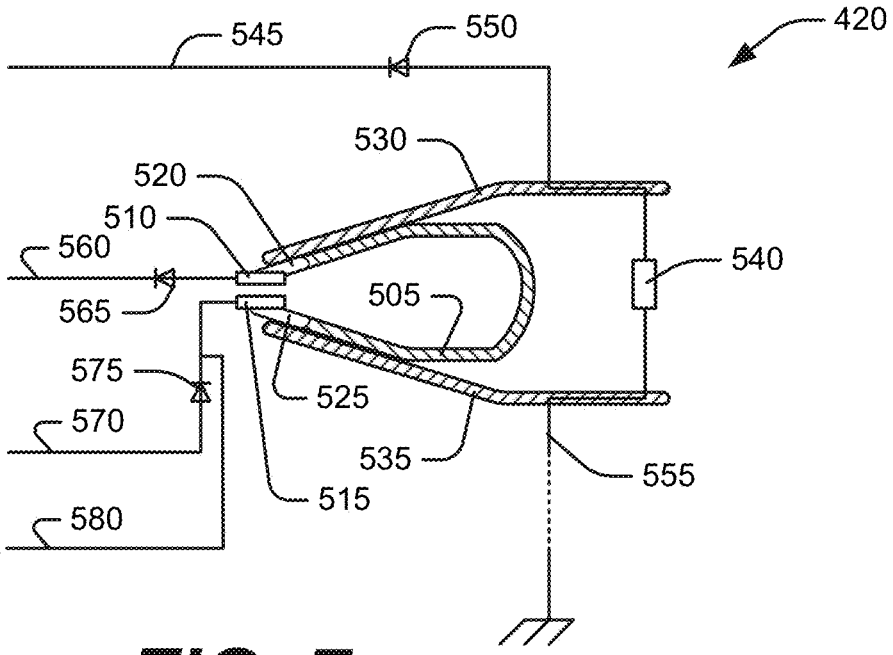
Figure 8:
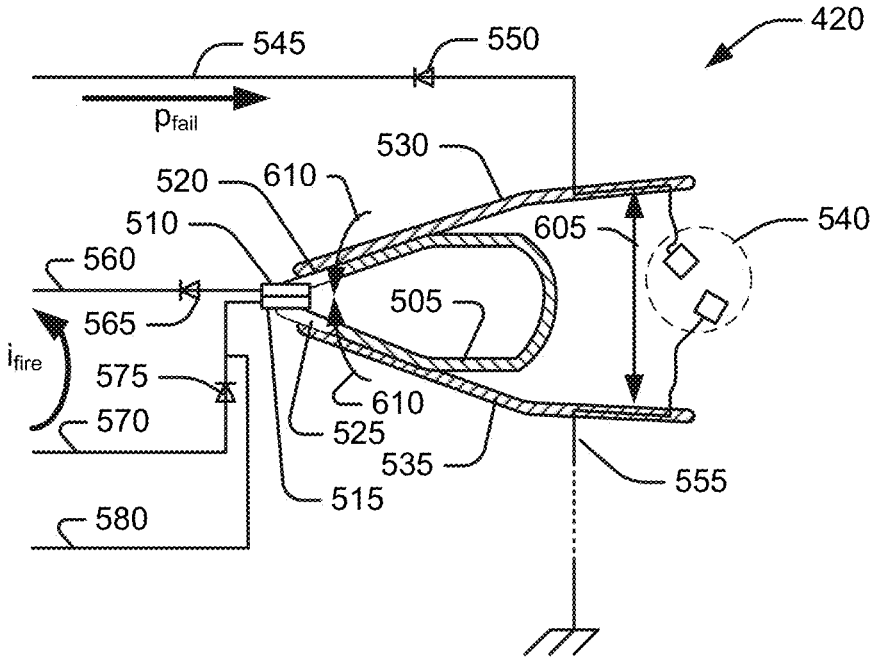

In one embodiment, shown in FIG. 7, the direction of current flow (or the polarity of the applied power) can be reversed in both the actuation circuit, the circuit that includes the collapsing element 540, and the firing circuit, the circuit that includes the first contact 510 and the second contact 515. In one embodiment, the direction of current flow in the actuation circuit can be reversed by reversing the polarity of diode 550. In one embodiment, the direction of current flow in the firing circuit can be changed by changing the polarity of diodes 565 and 575. Thus, in FIG. 5 the actuation circuit is activated by negative power and in FIG. 7, the actuation circuit is activated by positive power. In FIG. 5 the firing circuit is activated by positive power and in FIG. 7, the firing circuit is activated by negative power. In both FIG. 5 and FIG. 7, the power to activate the actuation circuit has the opposite polarity of the power to activate the firing circuit. FIG. 8, which is the same as FIG. 6 except for the polarity of $i_{fail}$ and $i_{fire}$, shows the fire clip switch 420 after the collapsing element 540 has failed.

Figure 9:
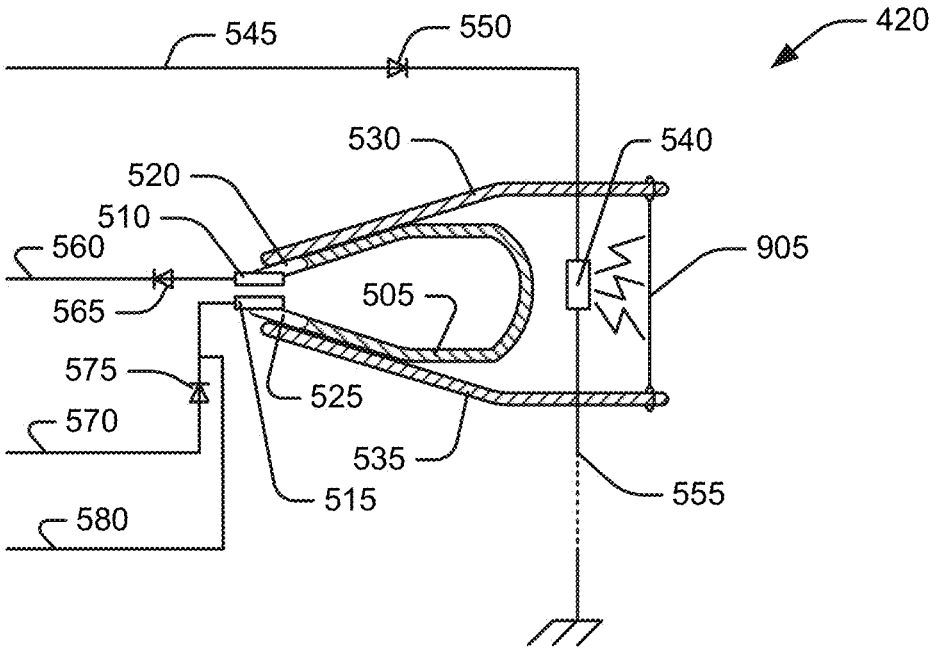

In one embodiment, illustrated in FIG. 9, the collapsing element 540, rather than failing itself, causes a restraining element 905 to fail. In one embodiment, the strain on the spring 505 is created by the restraining element 905 rather than the collapsing element 540. In one embodiment, while the collapsing element 540 is mechanically coupled to the handles 530 and 535, the mechanical coupling is not sufficiently strong to maintain the handles 530 and 535 in the positions shown in FIG. 9. Instead, the handles 530 and 535 are maintained in the positions shown by the restraining element 905.

In one embodiment, the restraining element 905 is an element that is predictably susceptible to failure when it exposed to heat. In one embodiment, the restraining element 905 is a tie wrap. In one embodiment, the restraining element is a rubber band. In one embodiment, the restraining element 905 905 is a eutectic substance, i.e., a mixture of two or more substances with a melting point lower than that of any of the substances in the mixture. In one embodiment, the eutectic substance is solder.

Figure 10:
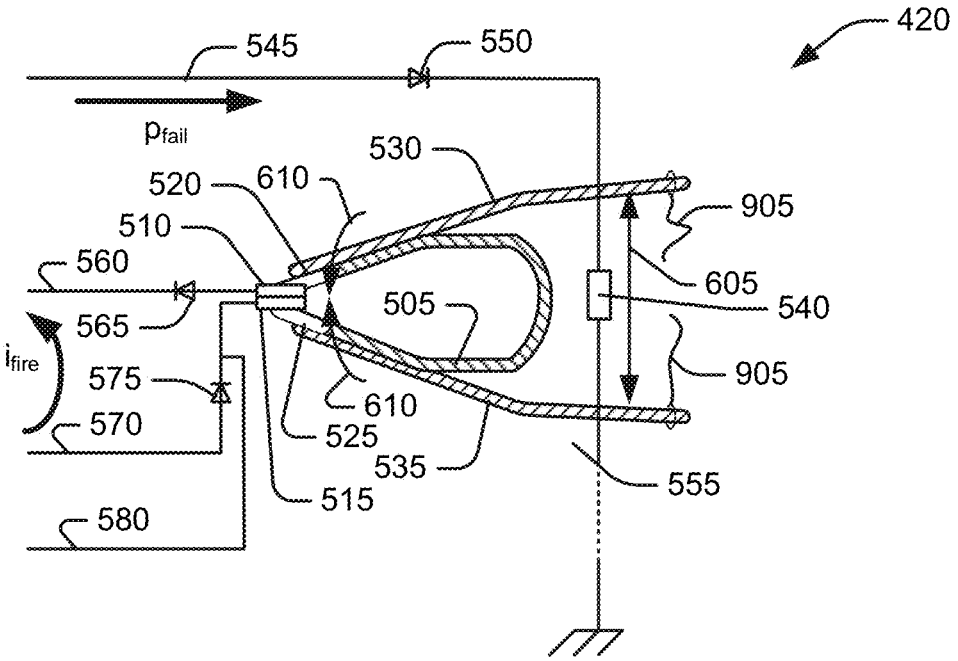

In one embodiment, the circuit in FIG. 9 operates in the same way as the circuit shown in FIG. 5 except that instead of the collapsing element 540 failing as in FIG. 5, heat from the collapsing element 540, indicated by the lightning bolt symbols adjacent the collapsing element 540 in FIG. 9, cause the restraining element 905 to melt or otherwise change state and fail or to weaken sufficiently to allow the spring to relax. The result, as shown in FIG. 10, is the same as in FIG. 6, except that the restraining element 905 has failed instead of the collapsing element 540. The contacts 510 and 515 have closed allowing the firing current $i_{fire}$ to flow through the firing circuit.

In one embodiment, illustrated in FIG. 11, a plurality of fire clip switches, such as those illustrated in FIGS. 5-10, is incorporated in a gun string. In the figure, the dashed lines separate tandem subs, denoted by the letter "T," and perforating guns, denoted by the letter "G." In one embodiment, the tandem subs hold the fire clip switches and interconnect the perforating guns. In one embodiment, the fire clip switches are installed alternately, i.e., a positive switch follows a negative switch and vice versa. In one embodiment, the bottommost fire clip switch is a positive fire clip switch, as shown in FIG. 11. In one embodiment, the bottommost fire clip switch is a negative fire clip switch.

The filled circles in FIG. 11 represent sealed contacts between the tandem subs and the perforating guns. In one embodiment, a setting tool (not shown) is included and similar sealed contacts are provided between the setting tool and the bottommost perforating gun. In one embodiment, each of the dashed boxes represents a positive fire clip switch, such as that shown in FIGS. 5, 6, 9, and 10, or a negative fire clip switch, such as that shown in FIGS. 7 and 8. The resistors in the gun portions of FIG. 11 represent detonators that, in one embodiment, fire when sufficient current flows through them. The tandem subs and perforating guns are arranged in a string with the bottom of the string represented at the far right of FIG. 11 and the top of the string represented at the far left of FIG. 11.

In one embodiment, a POWER line crosses through all the tandems and guns except for the bottom one. In one embodiment, the "actuation" line of the bottommost fire clip switch is connected to the "power" line, as shown in FIG. 11. In one embodiment, the "enable" line of the bottommost fire clip switch is connected to the "actuation" line of the fire clip switch of immediately above it in the string, as shown in FIG. 11. In one embodiment, the "actuation" line of all but the bottommost fire clip switch is connected to the "enable" line of the fire clip switch below it in the string, as shown in FIG. 11.

In one embodiment, at installation time all switches are in an open state where the contacts do not touch each other, such as that shown in FIGS. 5, 7, and 9. In one embodiment, the wires going from a tandem sub to a gun are hydraulically sealed, as indicated by the filled circles on FIG. 11, to prevent fluid from entering a tandem sub after the gun immediately below is fired and borehole fluids fill the gun body.

In one embodiment, the bottommost switch is a positive fire switch, such as that shown in FIGS. 5, 6, 9, and 10. In one embodiment, all switches in the string are stressed, keeping the electrical contacts separated (i.e., the contacts associated with each switch are not in contact with each other). The stress is held by the collapsing element 540 or by the restraining element 905. In one embodiment, when sufficiently high negative voltage is applied to the power line in FIG. 11, which corresponds to the actuation line 545 in FIGS. 5-10, a large current flows through diode 550 and through the collapsing element 540. In one embodiment, the current causes the collapsing element 540 or the restraining element 905 to fail, assisted by the force exerted by the spring 505, as discussed above. In one embodiment, the force of the spring is also used also to enhance the quality of the grounding connection to the gun chassis. In one embodiment, diodes 565 and 575 provide a double barrier against accidentally firing the detonator while the switch is being actuated. In one embodiment, as the collapsing element 540 or the restraining element 905 fails, the spring relaxes and the contacts 510 and 515 come together. This creates a path is created for positive current to flow from the power line through diodes 565 and 575 through the detonator to the gun chassis, which, in one embodiment, is the circuit ground.

In one embodiment, when the detonator is fired using positive voltage, the switch installed in the gun above, which uses a switch of opposed polarity, is actuated and its contacts are shorted (causing its associated switch to be closed). In one embodiment, the detonator in that gun (or in a setting tool if included) can now be fired using negative voltage.

In one embodiment, all subsequent guns are fired in accordance with the procedure presented above, until the last gun is fired. In one embodiment, the gun string is engineered so that the collapsing element 540 or the restraining element 905 collapses before the borehole fluid invades the fired gun (and shorts the actuation line).

In one embodiment, the system shown in FIG. 11 presents no significant ohmic losses, which allows it to be used with gun strings involving a very large number of perforating guns. In one embodiment, this also means that the surface system, i.e., the firing panel 106, sees practically the same impedance across the shooting connection.

Figure 12:
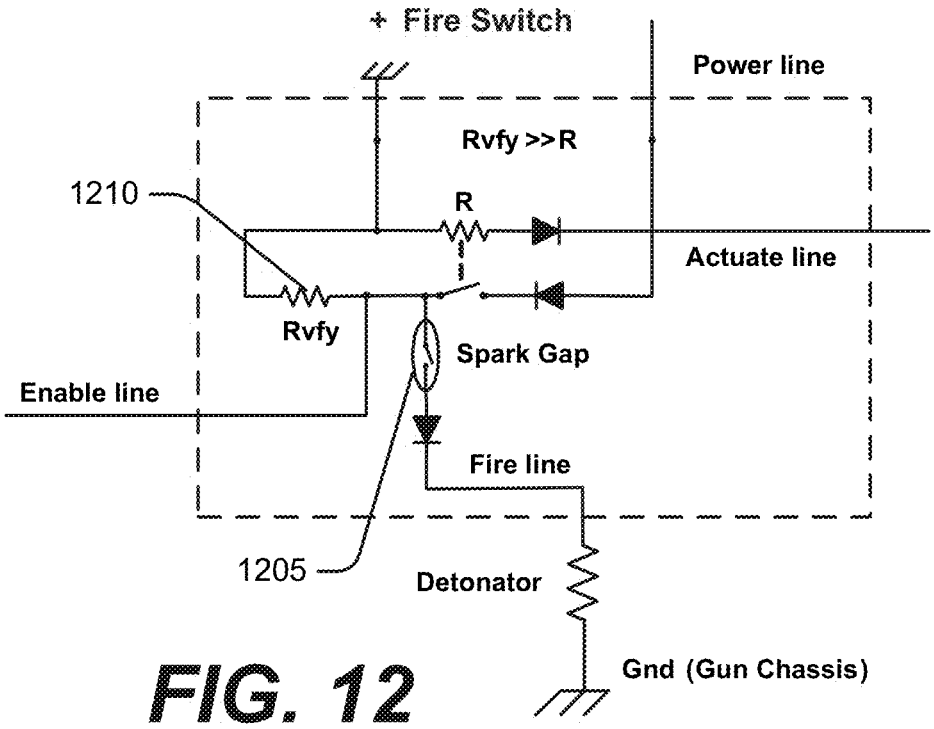

One embodiment, illustrated in FIG. 12, includes a voltage barrier, such as spark gap 1205, to give better assurance that the collapsing element 540 or the restraining element 905 collapses before the explosion takes place, if, for example, the shooting voltage is ramped up instead of being applied in a single step/"voltage dump". In one embodiment in which the collapsing element is a resistor installed in series with another resistor (such as the resistance represented by wireline conductors) connecting to a power supply, the value of the resistor is chosen to be low enough that the voltage across it under maximum power conditions is always lower than the voltage barrier provided by a diode or set of diodes installed in series with the detonator.

Figure 13:
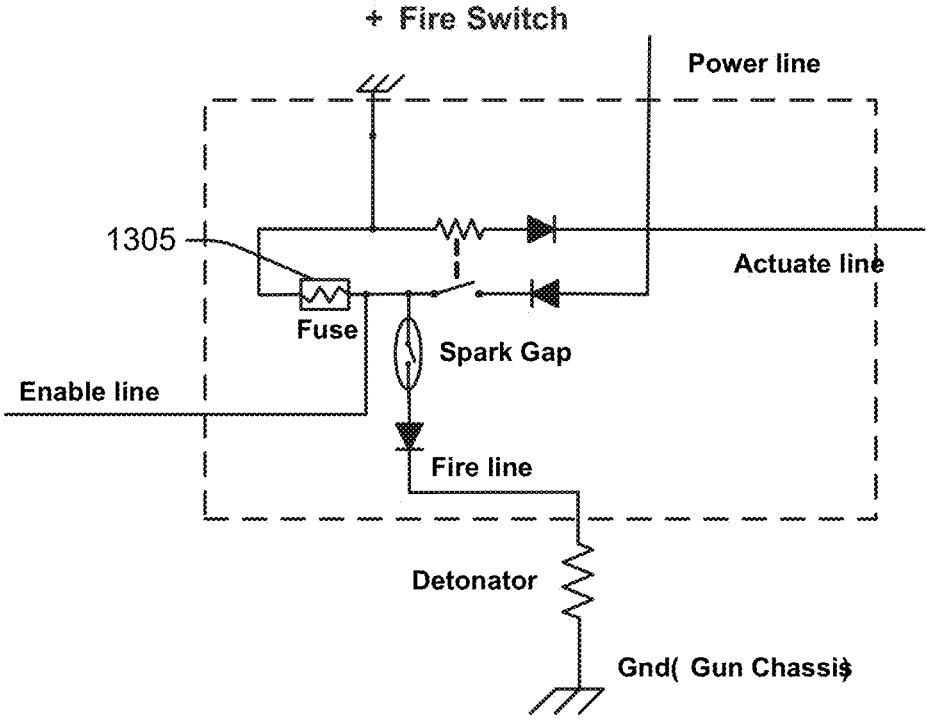

One embodiment, illustrated in FIGS. 12 and 13, includes a resistor (Rvfy), having an impedance much greater than the collapsing element 540, or a fuse 1305 that is used to verify through the power line (using a resistance meter) that the switch was successfully actuated. The change in line current that occurs when the fuse blows serves to indicate the actuation of the switch.

In one embodiment, the wires going from the tandem to the gun are not sealed with o-rings. In one embodiment, the seal is provided by an epoxy or another type of hydraulic sealing and non-conductive compounds that provides a barrier that prevents the fluids invading from reaching the upper gun and from coming in contact with the switch and shorting its contacts.

Figure 14:
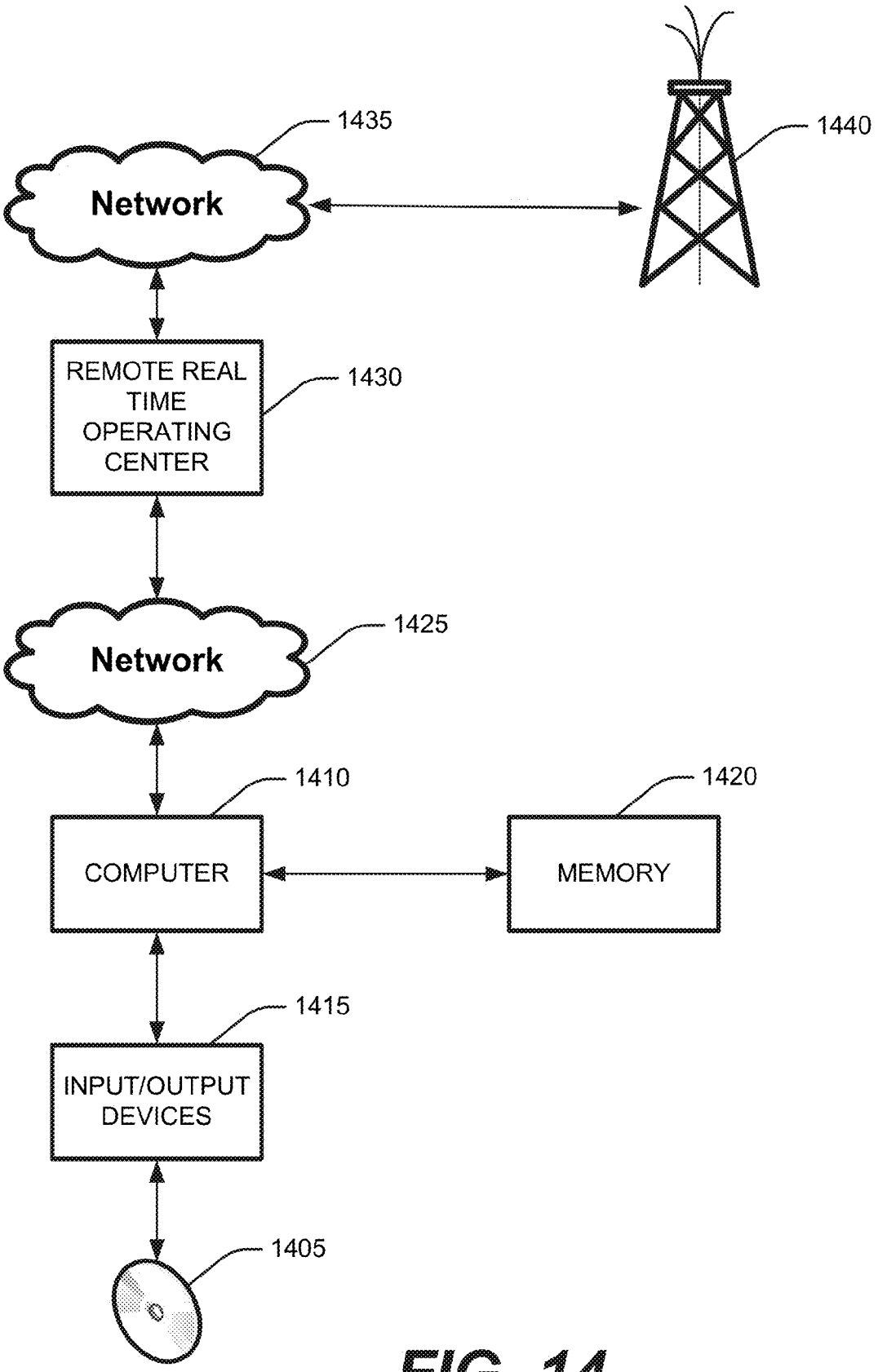
FIG. 14 illustrates a system that includes a perforation system.

In one embodiment, the perforating system is controlled by software in the form of a computer program on a computer readable media 1405, such as a CD or DVD, as shown in FIG. 14. In one embodiment a computer 1410, which may be the same as or included in the firing panel 106 or may be located with the perforation system, reads the computer program from the computer readable media 1405 through an input/output device 1415 and stores it in a memory 1420 where it is prepared for execution through compiling and linking, if necessary, and then executed. In one embodiment, the system accepts inputs through an input/output device 1415, such as a keyboard, and provides outputs through an input/output device 1415, such as a monitor or printer. In one embodiment, the system stores the results of calculations in memory 1420 or modifies such calculations that already exist in memory 1420.

In one embodiment, the results of calculations that reside in memory 1420 are made available through a network 1425 to a remote real time operating center 1430. In one embodiment, the remote real time operating center 1430 makes the results of calculations available through a network 1435 to help in the planning of oil wells 1440 or in the drilling of oil wells 1440.

While the fire clip switch has been described herein in the context of oil well perforation operations, it should be understood that the switch described above could be used in other contexts as well. Further, within the context of oil well perforation operations, the fire switch described herein could be used in actuation of a setting tool.

The word "coupled" herein means a direct connection or an indirect connection.

The text above describes one or more specific embodiments of a broader invention. The invention also is carried out in a variety of alternate embodiments and thus is not limited to those described here. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

The invention claimed is:

1. A switch comprising:
a spring;
a collapsing element;
the spring having a first state in which it is being bold in tension by a restraining element;
the spring having a second state in which it is not being held in tension because the restraining element has failed;
the collapsing element being situated such that when sufficient power is applied to the collapsing element heat from the collapsing element will cause the restraining element to fail;
a first contact coupled to the spring;
a second contact coupled to the spring;
the first contact and the second contact being separate from each other when the spring is in the first state;
the first contact and the second contact being electrically connected to each other when the spring is in the second state; and
wherein
a portion of the first end of the spring adjacent to where the first contact is coupled is non-conductive to electricity, and
a portion of the second end of the spring adjacent to where the second contact is coupled is nonconductive to electricity.

2. The switch of claim 1 wherein the restraining element is selected from a group consisting of a tie-wrap, a eutectic substance, and the collapsing element.

3. The switch of claim 1 further comprising:
a tension element coupled to the spring and the restraining element such that:
when the restraining element has not failed the spring is in tension; and
when the restraining element has failed the spring is not in tension.

4. The switch of claim 1 wherein:
the spring is C-shaped, having a first end, a second end, and an arced element coupled to and between the first end and the second end;
the first contact is coupled to the first end of the spring;
the second contact is coupled to the second end of the spring;
a first elongated tension element is provided that has a proximate end coupled to the first end of the spring;
a second elongated tension element is provided that has a proximate end coupled to the second end of the spring;
moving a distal end of the first elongated tension element toward a distal end of the second elongated tension element causes the first end of the spring to separate from the second end of the spring; and
the restraining element is coupled between the distal end of the first elongated tension element and the distal end of the second elongated tension element such that the first end of the spring is separated from the second end of the spring.

5. The switch of claim 1 further comprising:
a voltage baffler coupled to the first contact.

6. The switch of claim 5 wherein the voltage barrier comprises a spark gap.

7. The switch of claim 1 farther comprising:
a verification device coupled to the first contact.

8. The switch of claim 7 wherein the verification device is selected from the group consisting of a fuse and a resistor, the resistance of the resistor being much greater than the resistance of the collapsing element.

9. A method comprising:
coupling a first switch to a power line, the switch comprising:
a spring;
a collapsing element;
the spring having a first state in which it is being held in tension by a restraining element;
the spring having a second state in which it is not being held in tension because the restraining element has failed;
the collapsing element being situated such that, when sufficient current of a first polarity is applied to the switch, heat from the collapsing clement will cause the restraining element to fail;
a first contact coupled to the spring;
a second contact coupled to the spring;
the first contact and the second contact being separate from each other when the spring is in the first state;
the first contact and the second contact being electrically connected to each other when the spring is in the second state;
the first contact coupled to a first switch actuation line;
the first switch actuation line coupled to the power line; and
wherein:
a portion of the first end of the spring adjacent to where the first contact is coupled is non-conductive to electricity, and
a portion of the second end of spring adjacent to where the second contact is coupled is non-conductive to electricity; and
applying sufficient power of the first polarity through the power line to the first switch actuation line, such that the restraining element fails and the spring moves from the first state to the second state.

10. The method of claim 9 further comprising:

coupling the second contact to a second switch actuation line on a second switch; and after applying sufficient power of the first polarity through the power line to the first switch actuation line, directing current of a second polarity opposite the first polarity through the first contact and the second contact to:

a perforating gun; and the second switch actuation line, the second switch being constructed the same as the first switch except that the second switch requires sufficient power of the second polarity to cause the second switch to change from a first state to a second state.

11. The method of claim 9 further comprising:

coupling the second contact to a second switch actuation line on a second switch; and after applying sufficient power of the first polarity through the power line to the first switch actuation line, directing current of a second polarity opposite the first polarity through the first contact and the second contact to:

an explosive initiator in a setting tool; and the second switch actuation line, the second switch being constructed the same as the first switch except that the second switch requires sufficient power of the second polarity to cause the second switch to change from a first state to a second state.

12. The method of claim 9 wherein:

the first switch further comprises:

a verification device coupled to the first contact; and the method further comprises:

verifying that the restraining element has failed after applying sufficient power of the first polarity to the power line by detecting the presence of the verification device.

13. The method of claim 12 wherein detecting the presence of the verification device comprises measuring an impedance between the power line and a ground and comparing it to a known impedance of the verification device.

14. One or more non-transitory computer-readable media storing computer-executable instructions which, when executed on a computer system, perform a method comprising:

coupling a first switch to a power line, the switch comprising:

a spring;

a collapsing element;

the spring having a first state in which it is being held in tension by a restraining element;

the spring having a second state in which it is not being held in tension because the restraining clement has failed;

the collapsing element being situated such that, when sufficient current of a first polarity is applied to the switch, heat from the collapsing element will cause the restraining element to fail;

a first contact coupled to the spring;

a second contact coupled to the spring;

the first contact and the second contact being separate from each other when the spring is in the first state;

the first contact and the second contact being electrically connected to each other when the spring is in the second state;

the first contact coupled to a first switch actuation line;

the first switch actuation line coupled to the power line; and wherein:

a portion of the first end of the spring adjacent to where the first contact is coupled is non-conductive to electricity, and a portion of the second cod of the spring adjacent to where the second contact is coupled is non-conductive to electricity; and applying sufficient power of the first polarity through the power line to the first switch actuation line, such that the restraining element fails and the spring moves from the first state to the second state.

15. The computer-readable media of claim 14 Wherein the method further comprises:

coupling the second contact to a second switch actuation line on a second switch; and after applying sufficient power of the first polarity through the power line to the first switch actuation line, directing current of a second polarity opposite the first polarity through the first contact and the second contact to:

a perforating gun; and the second switch actuation line, the second switch being constructed the same as the first switch except that the second switch requires sufficient power of the second polarity to cause the second switch to change from a first state to a second state.

16. The computer-readable media of claim 14 wherein the method further comprises:

coupling the second contact to a second switch actuation line on a second switch; and after applying sufficient power of the first polarity through the power line to the first switch actuation line, directing current of a second polarity opposite the first polarity through the first contact; and the second contact to:

a explosive initiator in a setting tool; and the second switch actuation line, the second switch being constructed the same as the first switch except that the second switch requires sufficient power of the second polarity to cause the second switch to change from a first state to a second state.

17. The computer-readable media of claim 14 wherein:

the first switch further comprises:

a verification device coupled to the first contact; and the method further comprises:

verifying that the restraining element has failed after applying sufficient power of the first polarity to the power line by detecting the presence of the verification device.

18. The computer-readable media of claim 17 wherein detecting the presence of the verification device comprises measuring an impedance between the power line and a ground and comparing it to a known impedance of the verification device.

* * * * *